United States Patent [19]

Voss et al.

[11] 4,453,603

[45] Jun. 12, 1984

[54] APPARATUS AND METHOD FOR SELECTED PATH DRILLING

[75] Inventors: Stephen C. Voss, Lafayette, La.; John W. Voss, Yukon, Okla.; E. Bruce Damron, College Station, Tex.

[73] Assignee: Voss Development Corporation, Lafayette, La.

[21] Appl. No.: 214,753

[22] Filed: Dec. 9, 1980

[51] Int. Cl.[3] ..... E21B 3/12

[52] U.S. Cl. ..... 175/53; 175/62; 405/184

[58] Field of Search ..... 405/184, 154, 157, 161, 405/162, 178; 175/62, 53, 61, 73, 45, 107

[56] References Cited

U.S. PATENT DOCUMENTS

| | | | |
|---|---|---|---|
| 3,894,402 | 7/1975 | Cherrington | 175/62 X |
| 4,091,631 | 5/1978 | Cherrington | 405/184 |
| 4,117,895 | 10/1978 | Ward et al. | 175/62 X |
| 4,176,985 | 12/1979 | Cherrington | 405/184 |
| 4,221,503 | 9/1980 | Cherrington | 405/184 |
| 4,319,648 | 3/1982 | Cherrington | 405/184 X |

*Primary Examiner*—Dennis L. Taylor

*Attorney, Agent, or Firm*—Harold E. Meier

[57] ABSTRACT

A drilling rig for drilling a selected underground path is provided. The drilling rig includes a pipe handling apparatus having a hydraulic cylinder and ram mounted on an inclined ramp over a substructure wherein rooms for housing supplies and control equipment are provided. Methods for preparing an arcuate path opening, or for placing a pipeline and laying a cable wherein all pulling and pushing of pipe is accomplished by the hydraulic pipe handling apparatus are also provided.

13 Claims, 7 Drawing Figures

APPARATUS AND METHOD FOR SELECTED PATH DRILLING

TECHNICAL FIELD

This invention relates to arcuate path drilling systems and more particularly to the use of hydraulic cylinder means on an inclined ramp for pushing and/or pulling a drill string along a desired path.

BACKGROUND ART

Various techniques of drilling underground arcuate paths are known in the art. Such techniques are useful in accomplishing many tasks, including placing pipelines and the like underneath surface obstacles such as rivers and highways. One such technique involves advancing a directional drill in an inverted arcuate path underneath, for example, an obstacle to establish an initial hole. The inverted path underneath the obstacle is completed when the drill assembly emerges from the earth within a preselected target area on the opposite side of the obstacle. A drill pipe, having been advanced in sections behind the drilling apparatus, remains in the hole and extends from the entry point on one side of the obstacle to the exit point on the other side of the obstacle. After the hole has been established, a hole-opening operation may be undertaken wherein the initial hole may be enlarged to a preselected diameter in order to accommodate, for example, a pipeline or electrical cable. In some cases the initial hole is properly sized for the contemplated end use, so this hole-opening operation is performed only if needed.

One technique of drilling a hole, opening the hole, and placing a pipeline or cable in the opened hole involves the use of a travelling rotary drive on an inclined ramp attached to the end of the pipe being placed in the hole. The travelling rotary drive includes means for rotating the pipe to facilitate drilling or manipulating the direction in which drilling will proceed. It is necessary in such systems to provide some means for moving the rotary drive up and down the inclined ramp. It is also necessary to provide some means for applying a pushing or pulling force to the end of the pipe being placed in or withdrawn from the hole.

Prior art systems have used a length of cable fixed at each end to an inclined ramp and a winch or drum mechanism on a travelling rotary drive to move the rotary drive up and down the ramp on a dolly and to apply the pushing or pulling force heretofore described. Such a system is disclosed in U.S. Pat. No. 3,878,903, entitled "APPARATUS AND PROCESS FOR DRILLING UNDERGROUND ARCUATE PATHS."

DISCLOSURE OF THE INVENTION

The present invention is directed toward a drilling apparatus for drilling underground paths having an inclined ramp and a travelling rotary drive. A hydraulic cylinder and ram assembly moves the rotary drive up and down the ramp and applies pushing and pulling forces to a pipe on the ramp. Further, methods for drilling a selected underground path are disclosed wherein a hydraulic cylinder and ram assembly supplies all of the pushing and pulling forces necessary for moving all pipe. In these improved methods, a hydraulic cylinder and ram assembly mounted on an inclined ramp is used to push drill and hole-opening pipe strings in establishing an underground path and also is used if necessary to pull production pipe or cable back through the path from an exit point.

BRIEF DESCRIPTION OF THE DRAWINGS

A more complete understanding of the invention and its advantages will be apparent from the following Detailed Description taken into conjunction with the accompanying Drawings in which.

DETAILED DESCRIPTION

Figure 1:
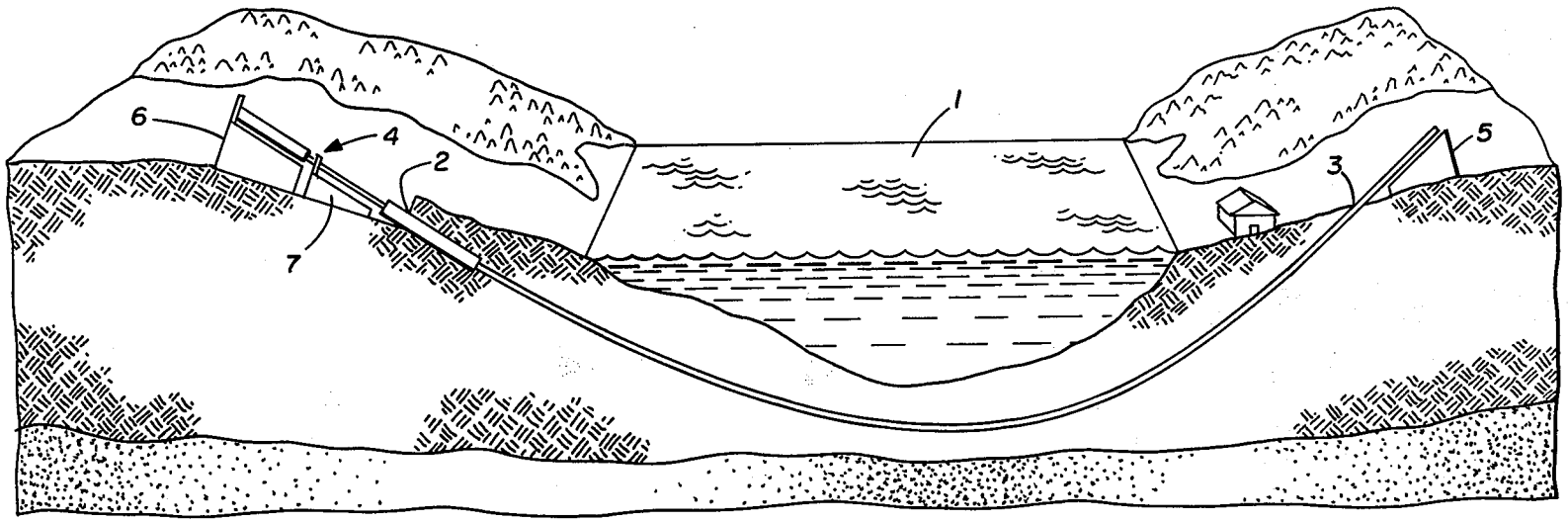
FIG. 1 is a cross sectional elevation view illustrating the operation of the present invention in drilling along an underground arcuate path.

The operation of the present invention in drilling along an inverted underground arcuate path is illustrated generally in FIG. 1. In the situation depicted in FIG. 1, it is desired to traverse river 1, drilling from entrance point 2 to exit point 3 on opposite sides of river 1. Drilling rig 4 is provided near entry point 2 and is described in more detail in connection FIGS. 2 through 7. Also shown in FIG. 1 is exit ramp 5 adjacent exit point 3. Exit ramp 5 may comprise any ramp structure which can support sections of pipe that emerge from exit point 3. Drilling rig 4 includes pipe handling apparatus 6 and a rotary drive unit 7. It will be understood that the situation depicted in FIG. 1, an underground traverse of a surface obstacle, is only one of many possible environments for the invention. The invention may also be used, for example, in subsurface mining operations for shaft drilling in conventional mining, horizontal completions for in-situ coal gasification projects, or horizontal completions to be used in the in-situ or thermally-enhanced recovery of tar sand or oil shale deposits.

Figure 2:
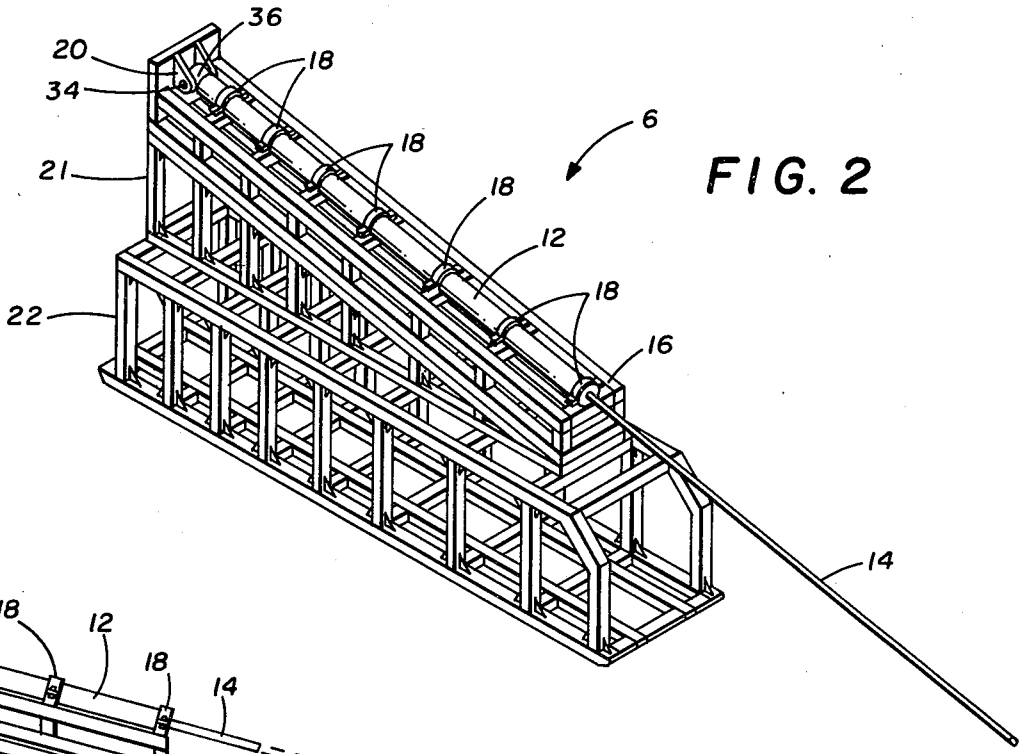
FIG. 2 is a perspective view of a pipe-handling apparatus equipped for carrying out the invention.

Referring now to FIG. 2, pipe handling apparatus 6 includes hydraulic cylinder 12 and ram 14. Ram 14 is shown in its fully extended position. Hydraulic cylinder 12 is mounted on upper ramp 16 by means of cylinder clamps 18 and is fixed at its upper end by pin anchor 20. Ramp 16 is supported by lower ramp 21 and substructure 22.

Figure 3:
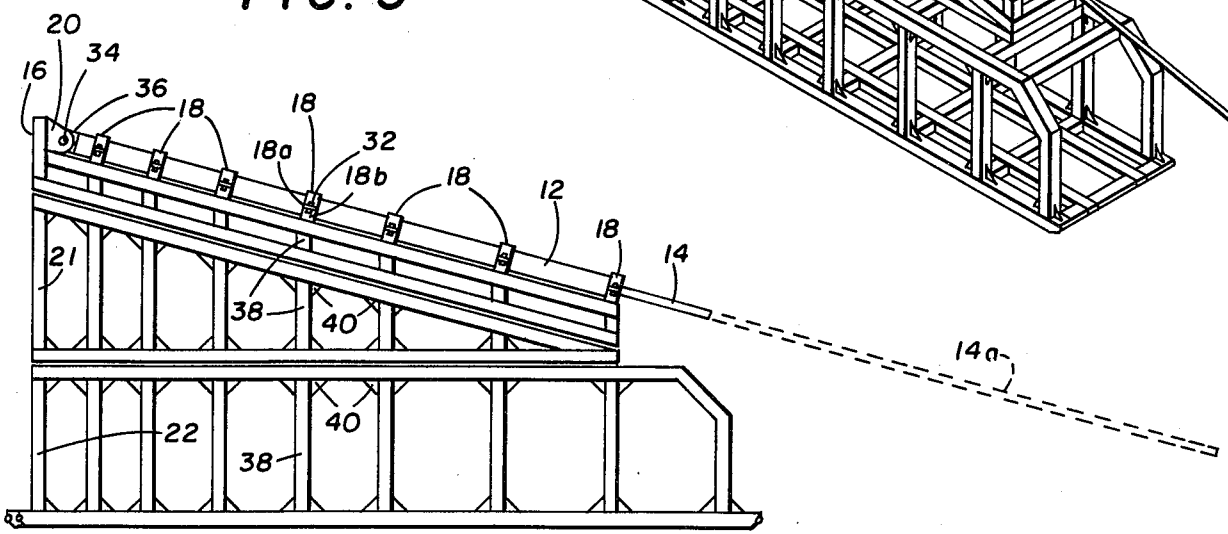
FIG. 3 is a side view of FIG. 2.

In FIGS. 2 and 3, like numerals are used for like and corresponding elements. In FIG. 3, ram 14 is shown in its fully retracted position. Phantom lines **14*a* indicate ram 14 in its fully extended position. Cylinder clamps 18 are fabricated in two parts, upper clamp shells 18*a* and lower clamp shells 18*b*, which are secured around hydraulic cylinder 12 by bolts 32. Pin anchor 20 includes pin 34 which passes through tongue 36 on the upper end of hydraulic cylinder 12. Upper ramp 16, lower ramp 21, and substructure 22 in the preferred embodiment are constructed of welded 12-inch "H" beams 38 reinforced by gussets 40**.

In the preferred embodiment, hydraulic cylinder 12 has an outer diameter of twenty-four inches and an inner bore of eighteen inches. Cylinder 12 and ram 14 are sized to provide a stroke of forty feet. Under a working pressure of one thousand p.s.i., hydraulic cylinder 12 provides pulling and pushing forces of lower ramp 21, and substructure 22 in the preferred embodiment are constructed of welded 12-inch "H" beams 38 reinforced by gussets 40.

In the preferred embodiment, hydraulic cylinder 12 has an outer diameter of twenty-four inches and an inner bore of eighteen inches. Cylinder 12 and ram 14 are sized to provide a stroke of forty feet. Under approximately 200,000 pounds. Ram 14 is a solid steel rod having a diameter of eight inches.

Figures 4, 5:
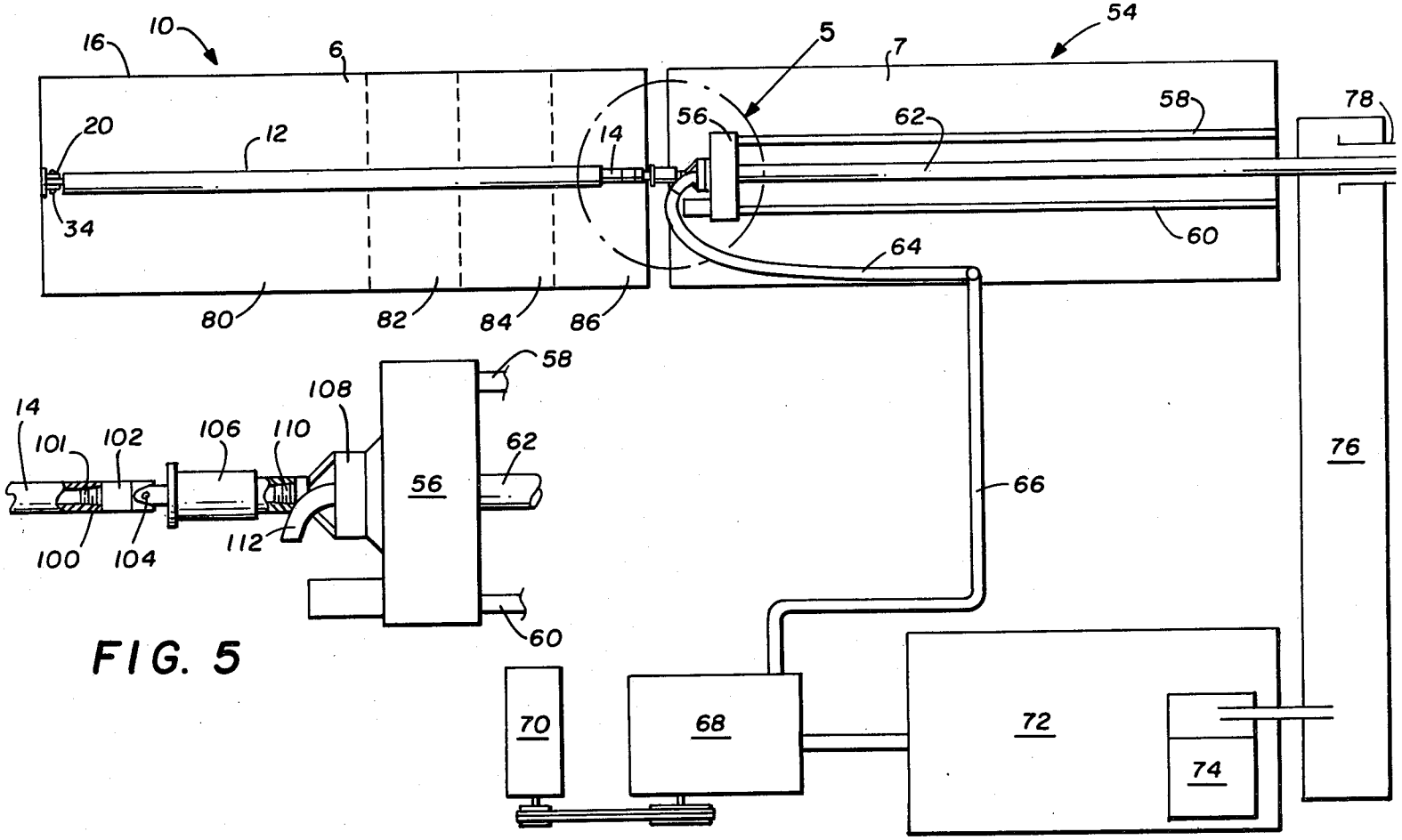
FIG. 4 is a schematic overhead view of a drilling system equipped for carrying out the invention.
FIG. 5 is an enlarged view of the pipe-handling apparatus and rotary drive assembly of FIG. 4.

FIG. 4 illustrates in schematic form a directional drilling rig equipped for carrying out the invention. Pipe handling apparatus 6 is placed adjacent and attached to rotary drive unit 7. Rotary drive unit 7 includes rotary drive ramps 58 and 60 on which rotary drive 56 may travel on a dolly or the like. Rotary drive 56 includes means for rotating a pipe 62 and means for introducing of drilling mud into pipe 62, described in more detail below in conjunction with FIG. 5. A mud pumping system is provided which includes flexible mud hose 64, mud line 66, mud pump 68, diesel engine 70, mud tank 72, shale shaker 74, and earthen pit 76. Also shown in FIG. 4 is conductor pipe 78.

Interior walls are provided between certain "H" beams 38 in substructure 22, in order to provide closed rooms for storage and the like. In this manner, utility room 80, supply room 82, personal room 84, and control room 86 are provided in substructure 22.

Referring now to FIG. 5, an enlarged area of FIG. 4 is shown illustrating the connection between pipe handling apparatus 6 and rotary drive unit 7. Threads 101 in the furthest end of ram 14 mate with matching external threads 100 of connector 102. In the preferred embodiment, threads 101 have a 6⅝" API-LH profile. Connector 102 is attached by pin 104 to travel joint 106, described in more detail in connection with FIG. 6. Travel joint 106 is connected to swivel 108 by means of threads 110. Swivel 108 includes gooseneck 112 and in the preferred embodiment is a standard hydraulic swivel such as an "L-series" swivel manufactured by Continental-Emsco. Gooseneck 112 is fitted for attachment to flexible mud hose 64 (not shown). Swivel 108 is connected to rotary drive 56, described in more detail in connection with FIG. 7.

Figure 6:
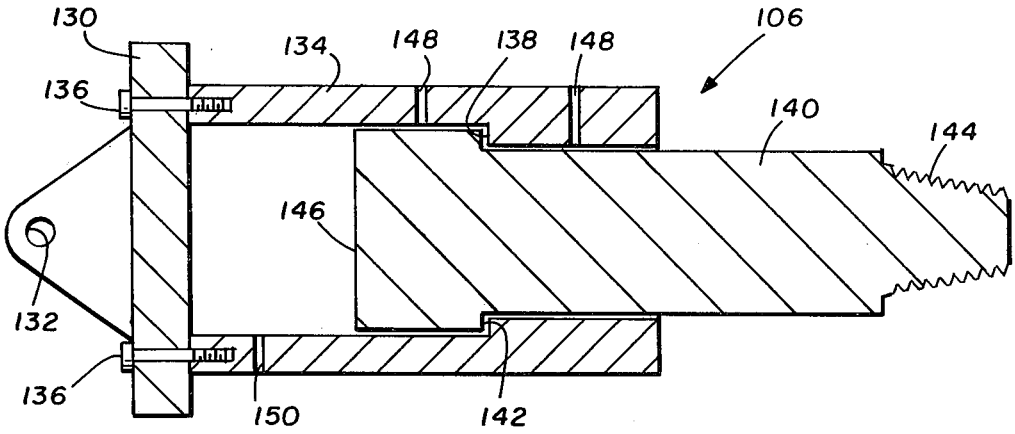
FIG. 6 is a sectional view of a travel joint for use in carrying out the invention.

Referring now to FIG. 6, travel joint 106 is illustrated. Travel joint 106 includes flange assembly 130 having pinhole 132 for connection to connector 102. Flange assembly 130 is attached to shell 134 by bolts 136. Shell 134 is a cylindrical member having shoulder 138 to contain travel member 140 which has a matching shoulder 142. Travel member 140 is machined from a solid piece of steel and has threads 144 machined thereon at its farthest end. In the preferred embodiment, threads 144 have a 4½" Reg. Pin profile. Travel joint 106 is approximately thirty inches long from flange assembly 130 to threads 144 and is shown in FIG. 6 in its fully extended position. When compressing forces are applied to travel joint 106, travel member 140 slides within shell 134 until end 146 of travel member 140 is adjacent flange assembly 130. In the preferred embodiment, travel joint 106 allows approximately six inches of travel. One or more grease holes 148 are provided in shell 134 to allow lubrication of travel joint 106 and one or more grease relief holes 150 are provided to allow the escape of excess lubricant.

Figure 7:
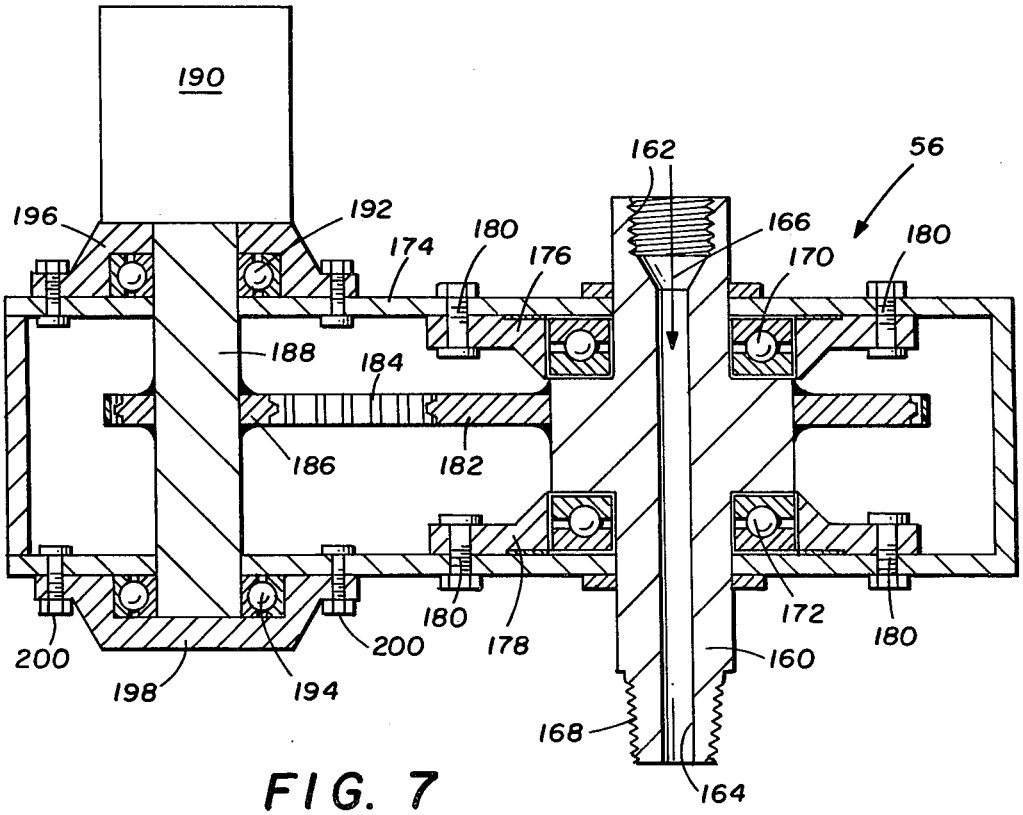
FIG. 7 is a sectional view of a rotary drive for use in carrying out the invention.

Referring now to FIG. 7, the interior construction of rotary drive 56 may be understood. Rotary drive 56 includes main shaft 160 in which threads 162 are provided for coupling with swivel 108. Main shaft 160 has an interior bore 164 to accommodate mud flow entering the shaft from swivel 108 and flowing in the direction indicated by arrow 166. Main shaft 164 also has threads 168 machined thereon to receive pipe 62. In the preferred embodiment threads 168 have a 4½" API FH profile. Thrust bearings 170 and 172 are provided for mounting main shaft 160 in case 174. Flanges 176 and 178 secure thrust bearings 170 and 172 to case 174 by means of bolts 180. Main shaft 160 has sprocket 182 attached for mating with chain 184. Chain 184 engages drive sprocket 186 mounted on drive shaft 188. Hydraulic motor 190 provides power to turn drive shaft 188 and thereby powers the turning of main shaft 160. Bearings 192 and 194 allow drive shaft 188 to freely turn in case 174 and are held in place by flanges 196 and 198 and bolts 200.

In operation, a production pipeline or a cable maybe placed in position underneath a surface obstacle such as river 1 in an operation having three main steps: (1) an initial hole is drilled from entry point 2 to exit point 3; (2) if necessary, the initial hole is opened to a preselected diameter to accommodate a production pipeline or cable; and (3) the production pipeline or cable is placed in the properly sized hole thereby completing the operation.

Initially, drilling rig 4 is moved to the location adjacent entry point 2 and the required angle for drilling rig 4 is established. Next, conductor pipe 78 is positioned by attaching it to rotary drive 56 and pumping mud down conductor pipe 78 to wash conductor pipe 78 into position. Pipe handling apparatus 6 will supply the pushing force necessary to wash conductor pipe 78 into position.

If the crossing area is such that conductor pipe 78 cannot be washed into place, a hole for conductor pipe 78 may be drilled with a conventional drill bit and drill pipe. The rotary action for the drill bit will be supplied by rotary drive 56 and pushing force will be supplied by pipe handling apparatus 6. After the hole is drilled, conductor pipe 78 may then be run into the hole and cemented in place.

Once these preliminary steps have been completed, the initial hole drilling step may commence. Pipe handling apparatus 6 and rotary drive unit 7 are used to apply pushing force to pipe 62 and introduce mud therethrough in order to advance pipe 62 and an attached drilling assembly. The hole is drilled underneath the surface obstacle by applying pushing force to pipe 62 and pumping drilling mud down pipe 62 through gooseneck 112 in swivel 108, thereby activating a drilling assembly at the end of pipe 62. The drilling assembly may include a mud-driven motor and drill bit, such as the "NAVI-DRILL" marketed by Christensen Downhole Tools. The direction and angle of the hole are monitored with a magnetic or gyroscopic down-hole survey instrument in order to ensure that the bit surfaces on the other side of the obstruction within the required target area. The survey instrument may, for example, be obtained from Sperry-Sun Tools. The direction in which the drilling assembly advances is controlled by varying the pushing force applied to pipe 62 by pipe handling apparatus 6 and by varying the angular condition of pipe 62 by means of rotary drive 56. It can be seen that swivel 108 isolates ram 14 from the angular variations introduced by rotary drive 56. As drilling progresses, rotary drive 56 and pipe 62 are advanced down ramps 58 and 60 by ram 14 until ram 14 is in its fully extended position. Pipe 62 is then disconnected from rotary drive 56, and rotary drive 56 is pulled back to its uppermost position by ram 14, until ram 14 is in its fully retracted position. At this time, a new section of pipe 62 may be placed in position and connected to swivel 108, whereupon drilling may resume. New sections of pipe 62 are added in this manner until the drilling operation is completed.

Drilling mud is provided through flexible mud hose 64 and mud line 66 from pump 68. Drilling mud exists the drilling assembly and returns to earthen pit 76 through conductor pipe 78 for recirculation.

Once the initial hole is completed and the drill bit surfaces, a hole-opening operation may be commenced. The drilling assembly is removed at exit point 3 and a hole-opening assembly is attached to pipe 62 at entrance point 2. The hole-opening assembly may include, for example, a "SECURITY" hole opener manufactured by Dresser Industries and a down-hole swivel ahead of the hole opener to prevent rotation of the drill string being pushed ahead and exiting at exit point 3. The hole-opening operation is like the initial hole drilling operation in that pipe handling apparatus 6 applies pushing force to guide pipe 62 and the hole-opening assembly into the hole. The pipe used to create the initial hole is ahead of the hole-opening assembly and is pushed out of the hole and disassembled at exit point 3 on exit ramp 5 as the hole-opening operation progresses.

Once the hole has been opened to the desired diameter and the hole opening assembly has emerged at exit point 3, the pipe laying or cable laying operation may begin. The hole opening assembly is removed at exit point 3 and the pipe to be used in the pipeline crossing is attached to the hole-opening pipe string at exit point 3. Pipe handling apparatus 6 and rotary drive unit 7 in a pulling mode are then used to remove the hole-opening pipe 62 and simultaneously pull the production pipe into position. In like manner, a cable may be attached to the hole-opening pipe string at exit point 3 and pulled through to entrance point 2. This operation will continue until the production pipeline or cable has been pulled through to the entrance side of the obstacle. This completes the pipe laying or cable laying operation.

While only one embodiment of the present invention has been described in detail herein and shown in the accompanying drawings, it will be evident that various further modifications are possible without departing from the scope of the invention.

We claim:

1. A drilling rig for drilling along a selected underground path comprising:

hydraulic pipe handling means including a double acting cylinder and a ram for applying pushing and pulling forces to a string of pipe sections, the pushing forces applied by the cylinder and ram being variable to control the direction of the pipe string along the selected path;

an inclined ramp supporting said pipe handling means for orienting said hydraulic means at a preselected angle; and rotary coupling means mounted on said ramp for connecting said hydraulic means to a pipe section and applying a rotational motion to said pipe in addition to the pushing and pulling forces applied to the pipe string.

2. The drilling rig of claim 1 further comprising ramp means for guiding said rotary drive means.

3. The drilling rig of claim 2 further comprising a drilling mud system for pumping drilling mud down said pipe through said rotary coupling means.

4. The drilling rig of claim 3 wherein said rotary coupling means comprises a hydraulic swivel and a rotary drive.

5. The drilling rig of claim 4 further comprising a travel joint.

6. A method for drilling along a selected underground path comprising the steps of:

orienting a hydraulic cylinder and ram at a preselected angle to establish the desired path for a string of pipe sections;

applying pushing forces to the string of pipe sections by means of the hydraulic cylinder and ram to control the forward advance and direction of the string of pipe sections along the selected path; and turning said drill pipe with a rotary drive attached to an end of said ram and to the section of the drill string.

7. The method of drilling along a selected underground path as set forth in claim 6 further comprising pumping mud into said pipe through a hydraulic swivel attached to an end of said ram.

8. A method for establishing an opening along a selected underground path comprising:

drilling an initial hole from an entrance point to an exit point by means of a drill bit, means for turning said drill bit, a first pipe string, and hydraulic means including a cylinder and ram for pushing said first pipe string, such that when said drill bit surfaces at the exit point a continuous length of said first pipe string is in place in the initial hole;

varying the pushing forces applied by the cylinder and ram to control the direction of the first pipe string along the selected path;

attaching a hole-opening device and means for turning the hole-opening device to said first pipe string at the entrance point; and opening the initial hole by means of a second pipe string and hydraulic means including a cylinder and ram for pushing said second pipe string from the entrance side, such that as opening progresses said first pipe string exits the initial hole at the exit point whereupon said first pipe string is disassembled, and when said hole opening device exits the opened initial hole at the exit point, a continuous length of said second pipe string is in place in the opened initial hole.

9. A method for placing a pipeline having a plurality of drill string sections comprising:

drilling an initial hole from an entrance point to an exit point by means of a drill bit, means for turning said drill bit, a first pipe string, and hydraulic means including a cylinder and ram for pushing said first pipe string, such that when said drill bit surfaces at the exit point a continuous length of said first pipe string is in place in the initial hole;

varying the pushing forces applied by the cylinder and ram to control the direction of the first pipe string along the selected path;

attaching a hole-opening device and means for turning the hole-opening device to said first pipe string at the entrance point;

opening the initial hole by means of a second pipe string and hydraulic means including a cylinder and ram for pushing said second pipe string from the entrance point, such that as opening progresses said first pipe string exits the initial hole at the exit point whereupon said first pipe string is disassembled, and when said hole opening device exits the opened initial hole at the exit point, a continuous length of said second pipe string is in place in the opened initial hole; and placing a production pipeline in the opened initial hole by attaching elements of said production pipeline to said second pipe string at the exit point and pulling said second pipe string and production pipeline through the opened initial hole by means of hydraulic means including a cylinder and ram for pulling at the entrance point.

10. A method for laying a cable comprising:

drilling an initial hole from an entrance point to an exit point by means of a drill bit, means for turning said drill bit, a first pipe string, and hydraulic means including a cylinder and ram for pushing said first pipe string, such that when said drill bit surfaces at the exit point a continuous length of said first pipe string is in place in the initial hole;

varying the pushing forces applied by the cylinder and ram to control the direction of the first pipe string along the selected path;

attaching a hole-opening device and means for turning the hole-opening device to said first pipe string at the entrance point;

opening the initial hole by means of a second pipe string and hydraulic means including a cylinder and ram for pushing said second pipe string from the entrance point, such that as opening progresses said first pipe string exits the initial hole at the exit point whereupon said first pipe string is disassembled, and when said hole opening device exits the opened initial hole at the exit point, a continuous length of said second pipe string is in place in the opened initial hole; and laying a cable in the opened initial hole by attaching an end of said cable to said second pipe string at the exit point and pulling said second pipe string and cable through the opened initial hole by means of hydraulic means including a cylinder and ram for pulling at the entrance point.

11. The method of claim 9 or 10 wherein said hydraulic means for pushing said first and second pipe strings comprises a hydraulic cylinder and ram mounted on an inclined ramp.

12. The method of placing a pipeline of claim 5 wherein said hydraulic means for pushing said first pipe string and second pipe string, and said hydraulic means for pulling said production pipe string comprises a double acting hydraulic cylinder and ram mounted on an inclined ramp.

13. The method of laying a cable of claim 6 wherein said hydraulic means for pushing said first pipe string and second pipe string, and said hydraulic means for pulling said cable comprises a double acting hydraulic cylinder and ram mounted on an inclined ramp.

* * * * *